US005293807A

United States Patent [19]

Hajdu

[11] Patent Number: 5,293,807

[45] Date of Patent: Mar. 15, 1994

[54] BULLET PROOF SHIELD ASSEMBLY

[76] Inventor: Sandor Hajdu, P.O. Box 37, Claverack, N.Y. 12513

[21] Appl. No.: 933,761

[22] Filed: Aug. 24, 1992

[51] Int. Cl.[5] ..... F41H 5/08

[52] U.S. Cl. ..... 89/36.7; 109/49.5

[58] Field of Search ..... 89/36.01, 36.04, 36.06, 89/36.07; 109/49.5, 79, 81, 85

[56] References Cited

U.S. PATENT DOCUMENTS 1,156,879 10/1915 Brown ..... 109/49.5

FOREIGN PATENT DOCUMENTS 71137 6/1916 Austria ..... 89/36.06
299117 9/1920 Fed. Rep. of Germany ..... 89/36.07
1168195 12/1958 France ..... 89/36.07
305808 12/1936 Italy ..... 89/36.07
225810 8/1943 Switzerland ..... 89/36.07
3801 of 1915 United Kingdom ..... 89/36.06

*Primary Examiner*—Stephen C. Bentley
*Attorney, Agent, or Firm*—Leon Gilden

[57] ABSTRACT

A bullet proof shield includes a first plate hingedly mounted to a second plate, with the first plate and second plate defining a slot, with the slot having a slot first abutment edge and second abutment edge that are coplanar to provide support for a firearm to direct fire through the slot. The shield is arranged to accommodate hingedly directing the first plate to the second plate, having first and second handle slots at equal orientations below coplanar top edges of the first and second plates to permit ease of transport and storage of the shield construction. Spike members projecting downwardly of the plates permit ease of positioning of the plates with an underlying ground surface.

2 Claims, 4 Drawing Sheets

BULLET PROOF SHIELD ASSEMBLY

BACKGROUND OF THE INVENTION

1. Field of the Invention

The field of invention relates to shield structure, and more particularly pertains to a new and improved bullet proof shield assembly wherein the same is arranged for portability for ease of use.

2. Description of the Prior Art

Various bullet proof shields have been available in the prior art as exemplified by the U.S. Pat. Nos. 4,674,394; 4,948,673; 3,858,242; and 4,633,756.

Accordingly, it may be appreciated that the shield structure of the prior art has typically been of a unitary type configuration to accommodate projection relative to individual body parts, wherein the instant invention attempts to overcome deficiencies of the prior art by providing for a shield that is arranged for ease of assembly and mounting for use in affording protection from a firing position and in this respect, the present invention substantially fulfills this need.

SUMMARY OF THE INVENTION

In view of the foregoing disadvantages inherent in the known types of bullet proof shield structure now present in the prior art, the present invention provides a bullet proof shield assembly wherein the same is arranged to provide for a plurality of bullet proof plates arranged for hinged construction relative to one another for ease of erecting the plates relative to one another for use as a shielding structure to afford protection rearwardly of the shield structure. As such, the general purpose of the present invention, which will be described subsequently in greater detail is to provide a new and improved bullet proof shield assembly which has all the advantages of the prior art shield apparatus and none of the disadvantages.

To attain this, the present invention provides a bullet proof shield including a first plate hingedly mounted to a second plate, with the first plate and second plate defining a slot, with the slot having a slot first abutment edge and second abutment edge that are coplanar to provide support for a firearm to direct fire through the slot. The shield is arranged to accommodate hingedly directing the first plate to the second plate, having first and second handle slots at equal orientations below coplanar top edges of the first and second plates to permit ease of transport and storage of the shield construction. Spike members projecting downwardly of the plates permit ease of positioning of the plates with an underlying ground surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bullet proof shield assembly which has all the advantages of the prior art shield assembly and none of the disadvantages.

It is another object of the present invention to provide a new and improved bullet proof shield assembly which may be easily and efficiently manufactured and marketed.

It is a further object of the present invention to provide a new and improved bullet proof shield assembly which is of a durable and reliable construction.

An even further object of the present invention is to provide a new and improved bullet proof shield assembly which is susceptible of a low cost of manufacture with regard to both materials and labor, and which accordingly is then susceptible of low prices of sale to the consuming public, thereby making such bullet proof shield assemblies economically available to the buying public.

Still yet another object of the present invention is to provide a new and improved bullet proof shield assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
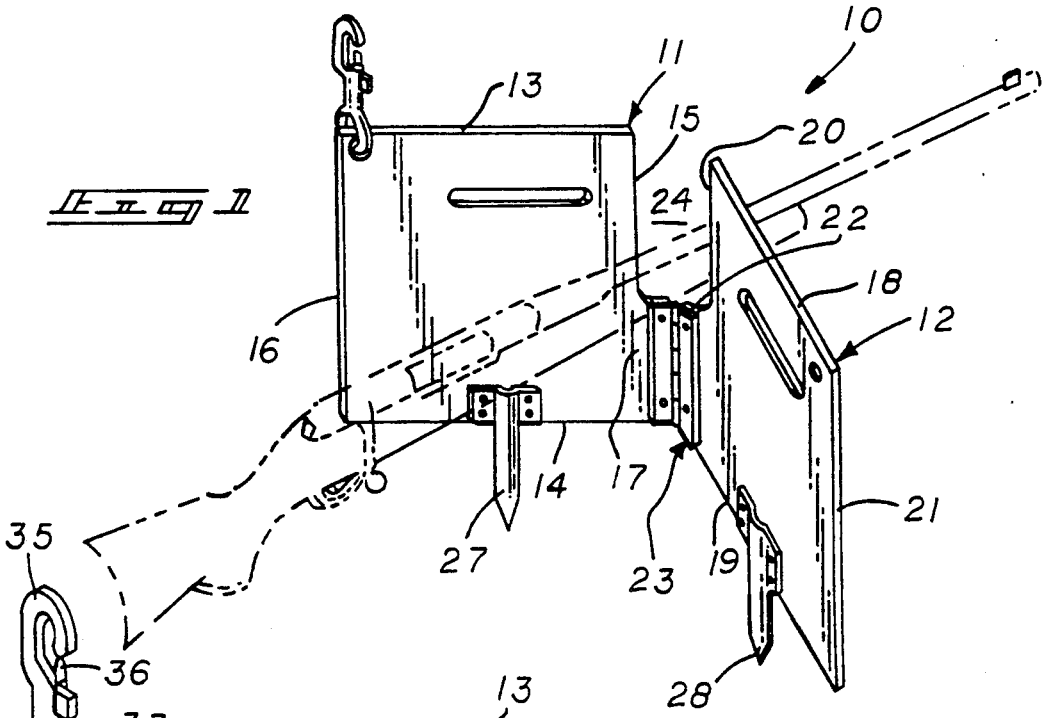
FIG. 1 is an isometric illustration of the instant invention.
Figure 2:
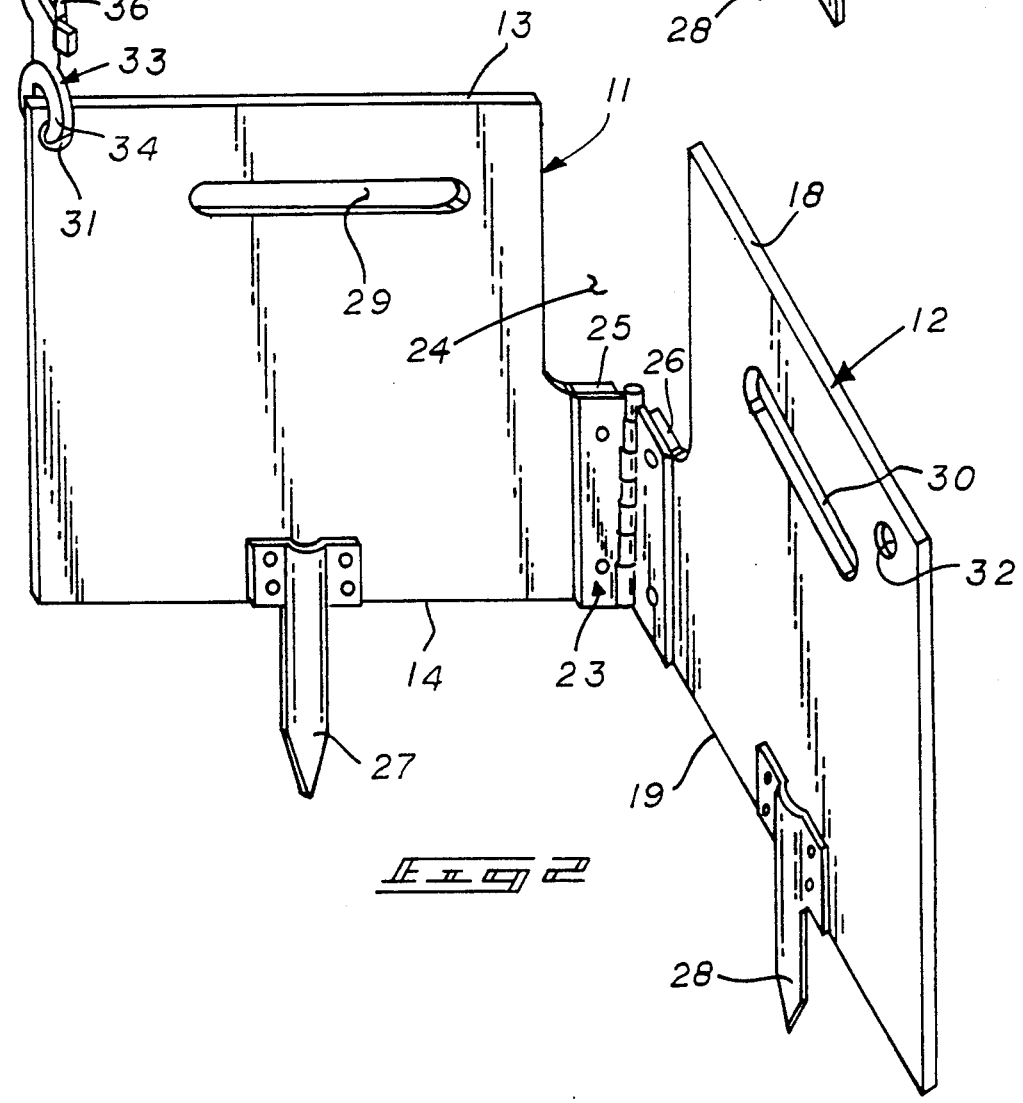
FIG. 2 is an enlarged isometric illustration of the invention.
Figure 3:
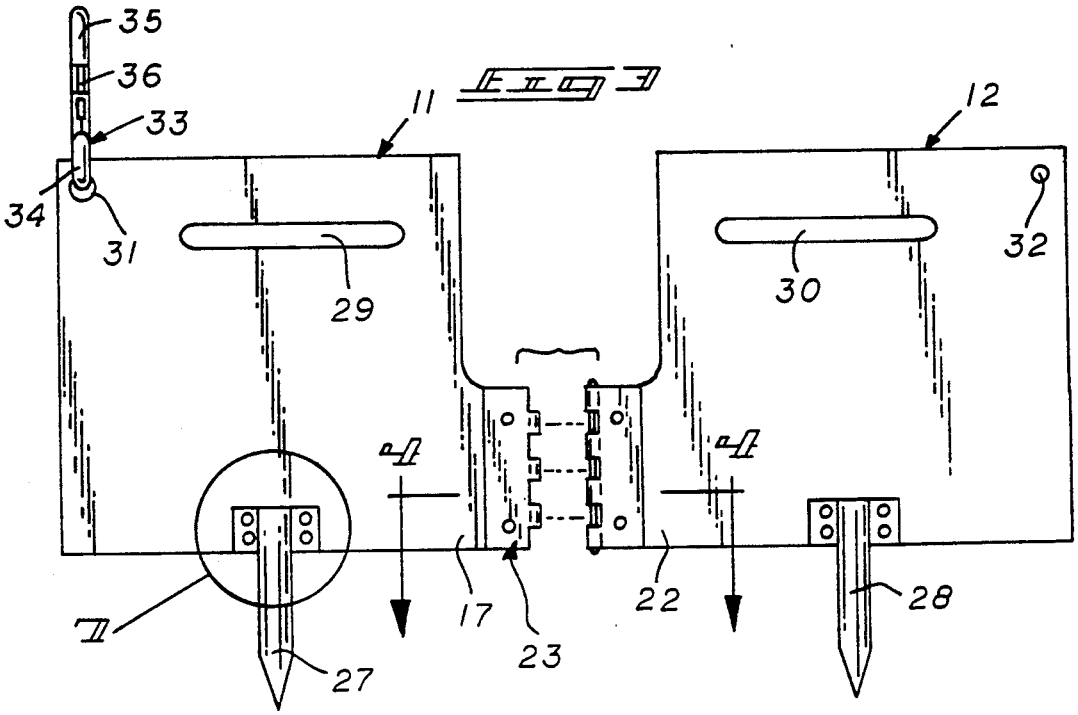
FIG. 3 is an orthographic view of the first shield plate relative to the second shield plate.
Figure 4:
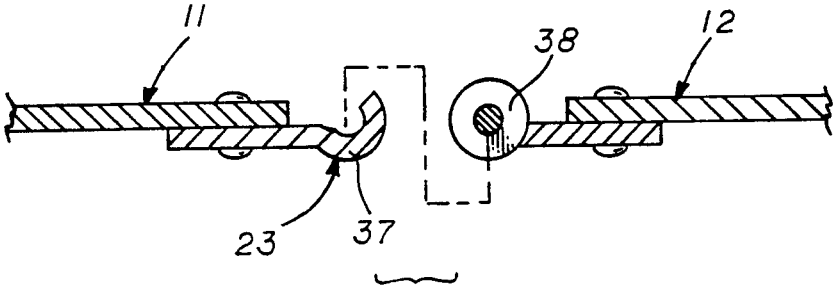
FIG. 4 is an orthographic view, taken along the lines 4—4 of FIG. 3 in the direction indicated by the arrows.

With reference now to the drawings, and in particular to FIGS. 1 to 9 thereof, a view and improved bullet proof shield assembly embodying the principles and concepts of the present invention and generally designated by the reference numeral 10 will be described.

More specifically, the bullet proof shield assembly 10 of the instant invention essentially comprises a first rigid armor plate 11 hingedly mounted relative to a second rigid armor plate 12. The armor plates may be formed of any commercially available armor material or such material as exemplified in U.S. Pat. No. 4,633,756 incorporated herein by reference.

The first plate 11 includes a first plate top edge 13 spaced from and parallel a bottom edge 14, with a first plate first side edge 15 spaced from and parallel a second side edge 16. A first side edge projection plate 17 coplanar with the first plate 11 projects beyond the first plate first side edge 15 mounted to a hinge 23. The second plate 12 includes a second plate top edge 18, a second plate bottom edge 19 parallel to the second plate top edge 18. A second plate first side edge 20 is oriented parallel relative to the second plate second side edge 21. A second plate first side edge projection plate 22 coplanar with the second plate 12 projects beyond the first side edge 20 and is coextensive with the first plate first side projection plate 17 and mounted to the hinge 23. The first plate first side projection plate 17 includes a first abutment edge 25 parallel to and oriented below the first plate top edge 13, with a second abutment edge 26 at a top edge of the second plate first side edge projection plate 22 formed with the second abutment edge 26 coplanar with the first abutment edge 25 and parallel to and below the second plate top edge 18. A slot 24 is accordingly defined between the first plate first side edge 15 and the second plate first side edge 20 and above the first abutment edge 25 and the second abutment edge 26.

A first spike 27 is fixedly mounted to and orthogonally directed below the first plate bottom edge 14. Similarly, a second spike 28 is orthogonally mounted to and projecting below the second plate bottom edge 19. The spikes permit securement of the shield assembly 10 with an underlying ground surface in use.

Figure 5:
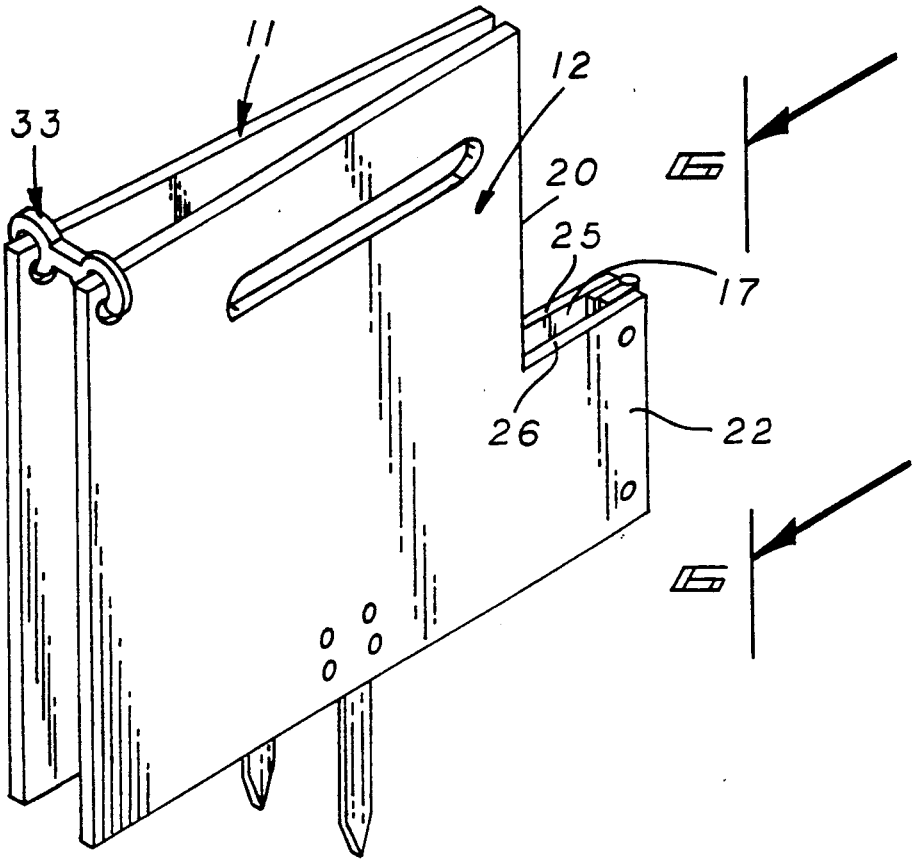
FIG. 5 is an isometric illustration of the invention in a collapsed configuration for ease of transport.
Figure 6:
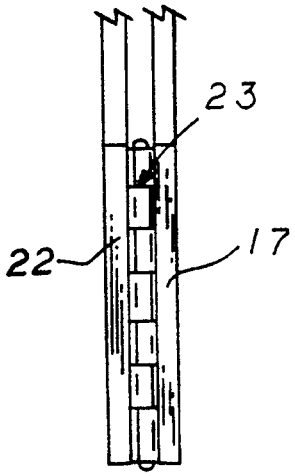
FIG. 6 is an orthographic view, taken along the lines 6—6 of FIG. 5 in the direction indicated by the arrows.

A first handle slot 29 spaced parallel to and below the first plate top edge 13 is oriented above the first abutment edge 25 and spaced below the first plate top edge 13 a predetermined spacing, with a second handle slot 30 spaced below the second plate top edge 18 said predetermined spacing and is substantially oriented to permit simultaneous grasping of the first and second handle slots 29 and 30 when the first and second plates are pivoted to a folded confronting relationship relative to one another, as indicated in the FIG. 5. Further to this end, a first aperture 31 directed through the first plate is oriented adjacent an intersection of the first plate top edge and the first plate second side edge. A second aperture 32 positioned adjacent an intersection of the second plate top edge and the second plate second side edge is provided. A capture clip 33 having a first loop 34 is constructed with the first loop 34 pivotally mounted through the first aperture 31. The capture clip 33 includes a second loop 35 having a slide bar 36 in sliding relationship relative to the second loop to permit access of the second loop 35 through the second aperture 32 upon displacement of the slide bar 36 relative to the second loop.

If required, the hinge construction 33 may be formed with discontinuous hinge legs 37 mounted to a first hinge plate (see FIGS. 3 and 4) cooperative with a hinge axle 38 mounted to a second hinge plate mounted to the second plate first side edge projection plate 22.

Figure 7:
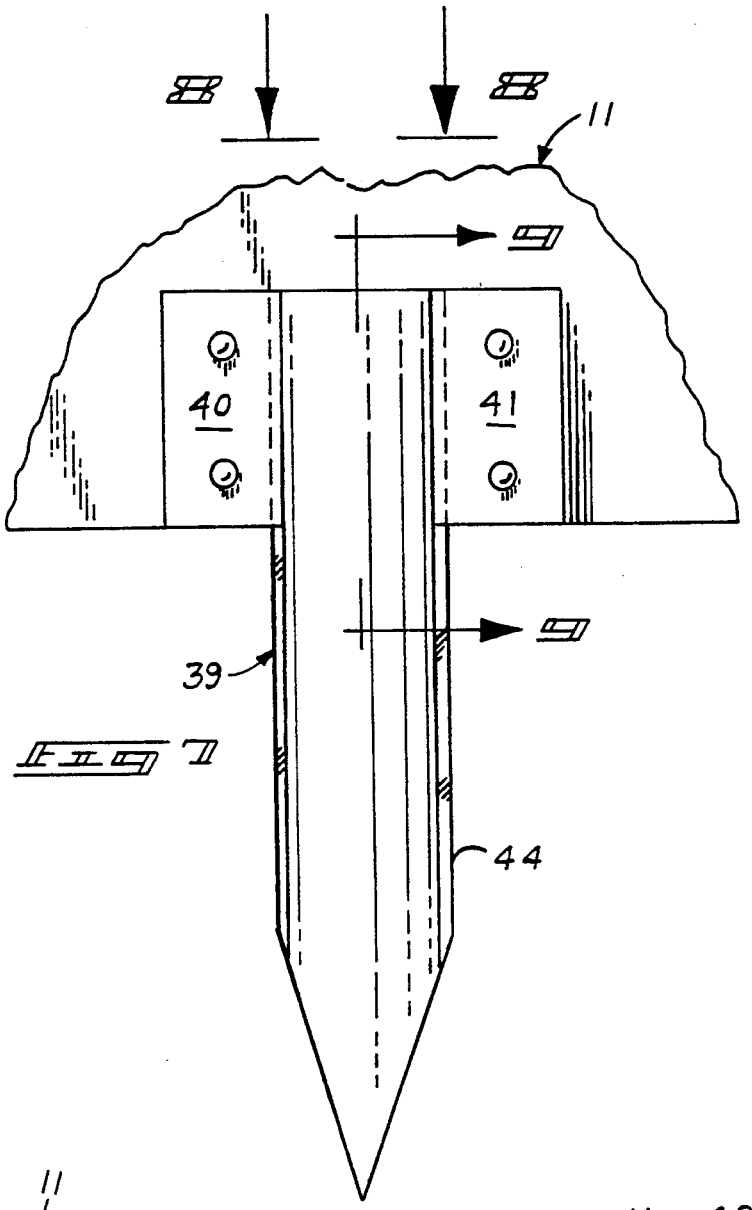
FIG. 7 is an orthographic view, taken in elevation, of a modified spike member.
Figure 8:
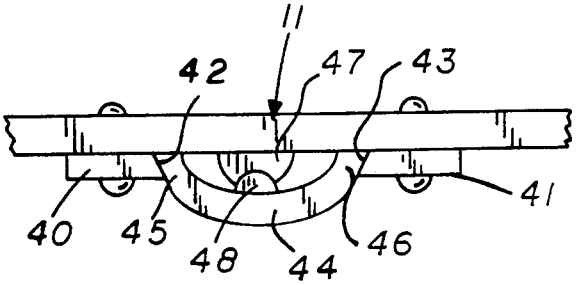
FIG. 8 is an orthographic view, taken along the lines 8—8 of FIG. 7 in the direction indicated by the arrows.
Figure 9:
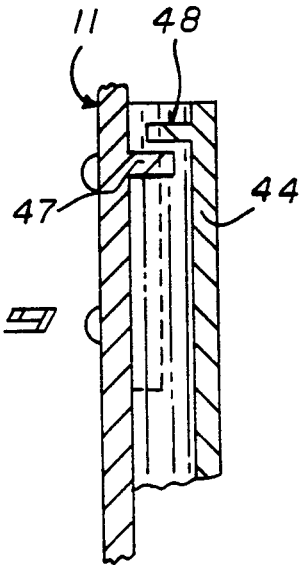
FIG. 9 is an orthographic view, taken along the lines 9—9 of FIG. 7 in the direction indicated by the arrows.

The FIGS. 7-9 indicate a modified spike member 39 utilized for the first and second spike members 27 and 28. As the spikes are of identical construction, only one such spike member 39 will be described, wherein it is understood that a second spike member mounted to the second plate is of identical construction. The spike member 39 includes a first spike plate 40 spaced from and parallel to a second spike plate 41. The first spike plate 40 includes a first plate beveled projection 42 parallel to and spaced relative to a second spike plate second beveled projection 43. A semi-cylindrical spike body 44 includes a spike body first end edge 45 captured between the first plate beveled projection 42 and the first plate 11. The spike body 44 includes a spike body second end edge 46 parallel to the first end edge 45, with the second end edge 46 slidably captured between the second beveled projection 43 and the first plate 11. To permit removal of the semi-cylindrical spike body 44 to minimize dangerous projections mounted relative to the plates 11 and 12 during transport, a first stop flange 47 is mounted to the plate 11 cooperative with a second stop flange 48 mounted to the spike body 44. The first and second stop flanges 47 and 48 are arranged for abutment relative to one another, with the second stop flange 48 positioned above the first stop flange 47. In this manner, downward projection of the spike body 44 relative to the spike plate is afforded, wherein upon transport of the organization, the spike body 44 is merely lifted and accordingly, the spike body first and second end edges 45 and 46 slide between the first and second spike plates 40 and 41 respectively to permit removal of the spike body 44 relative to each armor plate.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bullet proof shield assembly, comprising, a first rigid armor plate and a second rigid armor plate, a first rigid armor plate having a first plate top edge spaced from and parallel a first plate bottom edge, and a first plate first side edge spaced from the parallel a first plate second side edge, and the first plate first side edge including a first plate first side edge projection plate coplanar with the first plate projecting beyond the first plate side edge intersecting the first plate bottom edge, and the second plate having a second plate top edge spaced from and parallel a second plate bottom edge, and a second plate first side edge spaced from and parallel a second plate second side edge, and a second plate first side edge projection plate coplanar with the second plate intersecting the second plate bottom edge, wherein the first plate first side projection plate is coextensive with the second plate first side edge projection plate, and the first plate first side projection plate mounted to a hinge, and the second plate first side edge projection plate mounted to said hinge to pivotally mount the first plate to the second plate, with the hinge including a hinge axle and the hinge axle parallel to and oriented between the first plate first side edge and the second plate first side edge, and the first plate first side projection plate includes a first abutment edge orthogonally intersecting the first plate first side edge, and the second plate first side edge projection plate including a second abutment edge orthogonally intersecting the second plate first side edge, with the first abutment edge and the second abutment edge oriented in a coplanar relationship and spaced parallel to and below the first plate top edge and the second plate top edge, wherein the first plate top edge and the second plate top edge are coplanar relative to one another, and a slot is oriented between the first abutment edge and the second abutment edge and the second plate first side edge, wherein the first plate first side edge and the second plate first side edge are arranged in a coextensive relationship relative to one another in a confronting relationship, and a first spike mounted to the first plate orthogonally projecting below the first plate bottom edge, and a second spike mounted to the second plate orthogonally projecting below the second plate bottom edge, and a first handle slot directed through the first plate, with the first handle slot parallel to and below the first plate top edge and above the first abutment edge, and a second handle slot directed through the second plate parallel to and below the second plate top edge and above the second abutment edge, wherein the first handle slot and the second handle slot are spaced below the respective first plate top edge and second plate top edge and equal predetermined spacing, and a first aperture directed through the first plate in adjacency to the first plate second side edge, and a second aperture directed through the second plate in adjacency relative to the second plate second side edge, with the first aperture including a capture clip, the capture clip having a first loop pivotally mounted through the first aperture, and the capture clip including a second loop, the second loop having a slide bar, wherein the slide bar is reciprocatably mounted relative to the second loop to permit reception of the capture clip through the second aperture when the first plate is pivoted to the second plate in a confronting relationship.

2. A shield assembly as set forth in claim 1 wherein the first spike and the second spike each include a first spike plate and a second spike plate in a spaced parallel relationship, wherein the first spike plate includes a first plate beveled projection and the second spike plate includes a second plate beveled projection, and a semi-cylindrical spike body slidably mounted between the first spike plate and the second spike plate, wherein the spike body includes a first end edge parallel to a second end edge, and the first end edge is arranged in sliding communication relative to the first plate beveled projection, and the second end edge is arranged in sliding contiguous communication relative to the second plate beveled projection, and the first plate and the second plate each include a first stop flange, and the semi-cylindrical spike body of the first spike and the second spike includes a second stop flange, wherein the first stop flange and the second stop flange are arranged in a flange confronting relationship.

* * * * *